US008505247B2

(12) United States Patent
Epple

(10) Patent No.: US 8,505,247 B2
(45) Date of Patent: Aug. 13, 2013

(54) SWIMMING POOL SYSTEM WITH REINFORCED COMPOSITE STRUCTURAL COMPONENTS

(75) Inventor: Tom Epple, Fort Wayne, IN (US)

(73) Assignee: Separation LLC, Garrett, IN (US)

( * ) Notice: Subject to any disclaimer, the term of this patent is extended or adjusted under 35 U.S.C. 154(b) by 0 days.

(21) Appl. No.: 13/438,502

(22) Filed: Apr. 3, 2012

(65) Prior Publication Data

US 2012/0186185 A1 Jul. 26, 2012

Related U.S. Application Data

(63) Continuation of application No. 12/117,958, filed on May 9, 2008, now Pat. No. 8,215,069.

(60) Provisional application No. 60/917,497, filed on May 11, 2007.

(51) Int. Cl.
*E04B 1/00* (2006.01)

(52) U.S. Cl.
USPC ..... 52/169.7; 52/247; 52/582.2; 4/506

(58) Field of Classification Search
USPC ..... 52/169.7, 169.8, 169.1, 146, 247, 52/656.1, 656.9, 547, 245, 631, 582.2; 4/506, 4/513, 487, 488; 403/401–403; 249/196, 249/DIG. 3
See application file for complete search history.

(56) References Cited

U.S. PATENT DOCUMENTS

| | | | | |
|---|---|---|---|---|
| 1,299,200 | A | 4/1919 | McKay | |
| 3,080,022 | A | 3/1963 | Mote | |
| 3,862,737 | A | 1/1975 | Fuston, Jr. | |
| 4,401,291 | A | 8/1983 | Gallis | |
| RE32,181 | E | 6/1986 | Glonek et al. | |
| 4,635,304 | A | 1/1987 | Zikmanis et al. | |
| 5,251,868 | A | 10/1993 | Trimmer et al. | |
| 5,265,836 | A | 11/1993 | Dale | |
| 5,400,555 | A | 3/1995 | Kantor | |
| 5,673,528 | A * | 10/1997 | Danisch et al. | 52/506.05 |
| 6,283,439 | B1 | 9/2001 | Myers et al. | |
| 6,295,771 | B1 | 10/2001 | Desjoyaux et al. | |
| 7,412,802 | B2 | 8/2008 | Kantor | |
| 2005/0091934 | A1 | 5/2005 | Kantor | |
| 2005/0183260 | A1 | 8/2005 | Meyer | |

* cited by examiner

*Primary Examiner* — William Gilbert
(74) *Attorney, Agent, or Firm* — Taylor IP, P.C.

(57) ABSTRACT

A swimming pool has a plurality of wall panels secured together in an edge-to-edge relation to define the perimeter of the pool. At least one of the panels includes: a generally rectangular main body having a generally planar face forming a portion of a pool side wall; a pair of opposed edge flanges for juxtaposition with edge flanges of adjacent wall panels, the flanges extending from the plane of the body face at an angle differing from orthogonal by a small draft angle; and a plurality of elongated ribs extending along each flange of the at least one panel in a direction generally orthogonal to the plane of the body face.

3 Claims, 3 Drawing Sheets

SWIMMING POOL SYSTEM WITH REINFORCED COMPOSITE STRUCTURAL COMPONENTS

CROSS REFERENCE TO RELATED APPLICATIONS

This is a continuation of U.S. patent application Ser. No. 12/117,958, entitled "SWIMMING POOL SYSTEM WITH REINFORCED COMPOSITE STRUCTURAL COMPONENTS", filed May 9, 2008, now U.S. Pat. No. 8,215,069 which is incorporated herein by reference. U.S. patent application Ser. No. 12/117,958 claims the benefit of U.S. provisional patent application Ser. No. 60/917,497 filed May 11, 2007.

BACKGROUND OF THE INVENTION

1. Field of the Invention

The present invention relates to swimming pools, and, more particularly, to non-metal swimming pools.

2. Description of the Related Art

Swimming pools can be completely in the ground, aboveground or partially in the ground. Pools have a wall structure that either directly contains water therein or the wall structure supports a liner that contains the water. The pool wall structure may include individual panels that are interconnected to form a peripheral boundary for the pool.

Pool wall assembly techniques include excavation and filling with an easily gradable material in order to level the ground for the installation of a pool wall. Typically, in an inground swimming pool installation, a hole is dug which is larger than the perimeter of the swimming pool (e.g., 3 to 4 feet). The wall panels are connected in an end-to-end manner and placed at their approximate positions. Support braces are attached to the back of the wall panels for eventual anchoring to the ground. The panels are then aligned and leveled using a laser transit or the like, and fastened to the ground using the support braces and other structures (e.g., stakes, etc.) attached to the back of the wall panels or extending through the bottom flange of the wall panels. A concrete layer is poured in the bottom of the trench at the back of the panels to lock the panels and braces in place. Fill material, e.g., pea gravel, is then back filled around the wall panels and support braces.

When plastic or metal walls are used, it is common to hang a vinyl liner from a coping extending around the top periphery of the pool. The liner lies adjacent to the walls and across the bottom. A target water level is defined, being generally the level at which skimmers and return water lines are provided in the pool walls. The actual water level may, however, vary from the target water level.

Support braces of conventional design are sufficient to maintain the wall panels in a substantially immovable state while back filling, pouring concrete decking, etc. Such support braces typically have a generally triangular configuration with three outer members defining the triangular shape and supported by interior cross braces. These types of braces may be made from metal pieces welded together, or may be injection molded as an integral unit.

Plastic wall panels for swimming pools are conventionally made from a structural foam process, in which a suitable plastic is injected into a mold and a gas is injected into the plastic within the mold to foam the plastic, resulting in a substantially smooth outer skin and a honeycomb like interior structure. A problem with pool panels made from structural foam is that the plastic does not always fill the mold cavity, resulting in voids in the pool panel. Further, such pool panels are somewhat susceptible to impact damage and may tend to warp because of thermal stresses.

What is needed in the art is a pool assembly system with individual components and assembly techniques which results in higher quality, lower labor costs, and greater structural integrity and strength.

SUMMARY OF THE INVENTION

The present invention provides a swimming pool side wall panel construction which is less susceptible to deviation from coplanar and less susceptible to the formation of gaps between adjacent pool panels.

The invention comprises, in one form, a swimming pool having a plurality of wall panels secured together in an edge-to-edge relation to define the perimeter of a pool. The panels may have a generally rectangular main body with a generally planar face for forming a portion of a pool side wall and a pair of opposed edge flanges for juxtaposition with edge flanges of adjacent wall panels. These flanges extend from the plane of the body face at an angle differing from orthogonal by a small draft angle to facilitate removal of the panel from a mold. A plurality of elongated ribs extend along each flange in a direction generally perpendicular to the plane of the body face and compensate for the tendency for angular misalignment between adjacent panels induced by the draft angle.

Also in general, a compression plate assembly for use in a swimming pool has an elongated generally planar blade with an elongated lip extending from one edge along the length thereof and in a direction generally perpendicular to the plane of the blade. A plurality of fasteners in the form of alignment towers are fixed to the blade and extend from one blade surface in the direction of the elongated lip for joining a juxtaposed pair of swimming pool components such as side wall panels. The alignment towers are designed to extend through aligned apertures in flanges on the juxtaposed components with each having a transverse slot near a free end for receiving a wedge for clamping the flanges together. Pre-alignment tabs may also be included for insertion into corresponding aligned edge flange apertures to temporarily hold the juxtaposed components in position during insertion and tightening of the wedges.

An advantage of the present invention is a reduction in the tendency of pool side wall panel arrays to deviate from coplanar.

Another advantage is a reduction in the tendency for gapping between adjacent pool panels.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DESCRIPTION OF THE INVENTION

Figure 1:
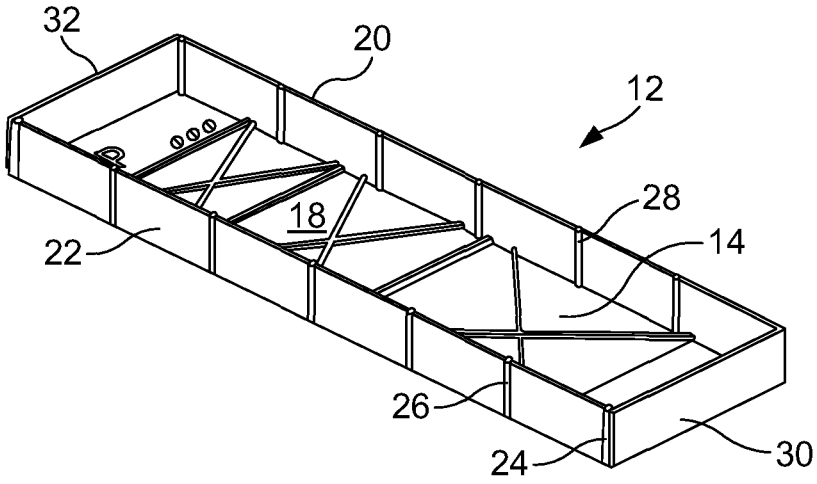
FIG. 1 is an isometric view of one swimming pool side wall panel.

Referring now to the drawings, and more particularly to FIG. 1, there is shown a swimming pool side wall panel 12 made from a compression molding process using fiber reinforced composites. Such composites typically include a polymer, resins and reinforcement fibers. The fibers may be, e.g., carbon, fiberglass, graphite and/or aramid fibers. The SMC (Sheet Molding Compound) thermoset plastic allows tighter tolerances not possible with structural foam plastic panels. The panel includes a generally rectangular main body 14 having a generally planar face 16 (FIG. 2) forming a portion of a pool side wall. The planar face 16 is the surface opposite the outside face 18 visible in FIG. 1. Panel 12 has a pair of opposed edge flanges 20 and 22 for juxtaposition with edge flanges of adjacent wall panels. The flanges 20 and 22 extend from the plane of the body face (and to the mold parting plane or outside edge 36 of the panel 12) at an angle differing from orthogonal by a small draft angle shown generally at 34 in FIG. 2. A plurality of elongated ribs such as 24, 26 and 28 extend along each flange in a direction generally orthogonal (89.90 degrees in FIG. 2) to the plane of the body face. Top 32 and bottom 30 flanges are also visible in FIG. 1.

Figure 2:
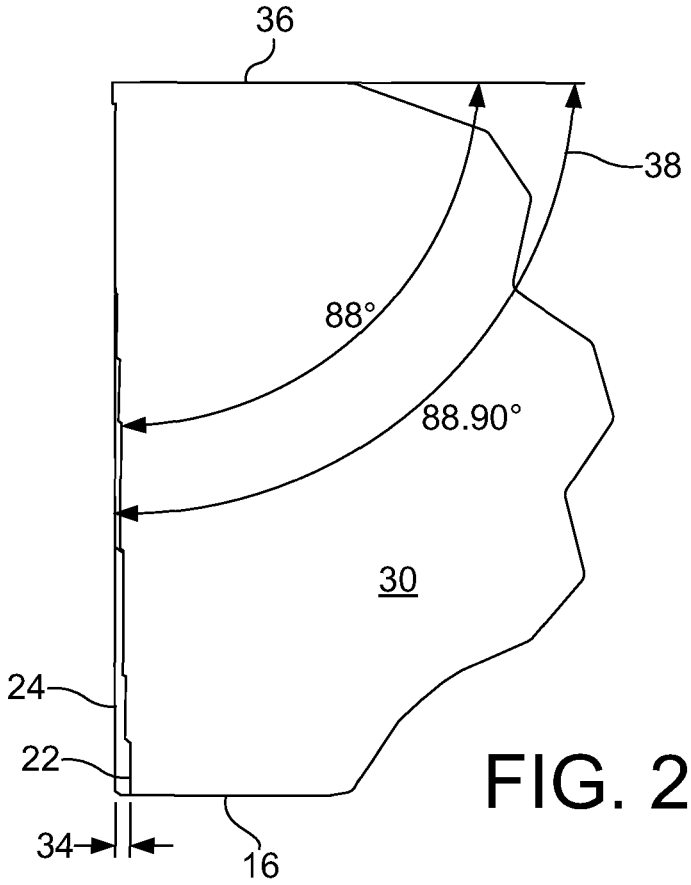
FIG. 2 is an end elevation view of a portion of one end of the side wall panel of FIG. 1.

Comparing FIGS. 1 and 2, each side wall panel includes a plurality of ribs 24, 26 and 28 formed as FML (Fiber reinforced Metal Laminate) flat features along the peripheral side edges or flanges thereof where the panel will be coupled with an adjacent panel. It will be appreciated that during the compression molding process, it is necessary to form the compression mold with a slight draft angle 34 at the side walls of the pool panel so that the pool panel can be removed after cooling (e.g., 2 degree draft angle). When the side wall panels are subsequently attached together at the side edges, the mating draft angles (totaling now about 4 degrees off perpendicular) cause the adjacent panels to be at a slight angle relative to each rather than being in line. If the panels are then "forced" to be in a straight line during assembly, a small gap forms at the inside of the pool panels that can allow the liner to protrude into this space and possibly cause damage to the liner. This is why duct tape or the like is typically placed by hand over the seams between adjacent panels in structural foam panels (which also have the same problem associated with a necessary draft angle for removal from the mold).

According to the present invention, a plurality of FML flats or ribs are provided along each peripheral side edge 20 and 22, which generally have an angular orientation 38 to offset for the draft angle in the mold. When these flats on adjacent panels abut each other, the panels are then at or nearly in perfect linear alignment (coplanar) with each other. The gap at the back of the panel also has the benefit of creating a tension load on the fasteners used to join adjacent panels together, and creates a preload at the front face which closes the gap at the inside of the pool. The surface area of the FML flats is small enough so as not to interfere with removal of the panels from the mold.

The panels may include mounting bosses at specific locations for attaching skimmers, etc, and also include template cutouts at specific locations for the same type of components. This reduces labor and the possibility of errors in cutting panels.

Several panels of the type shown in FIGS. 1 and 2 may be joined to form a pool side wall by any suitable technique. Also, suitable curved panels or abrupt corner configurations may be employed to complete an enclosed pool.

Figure 3:
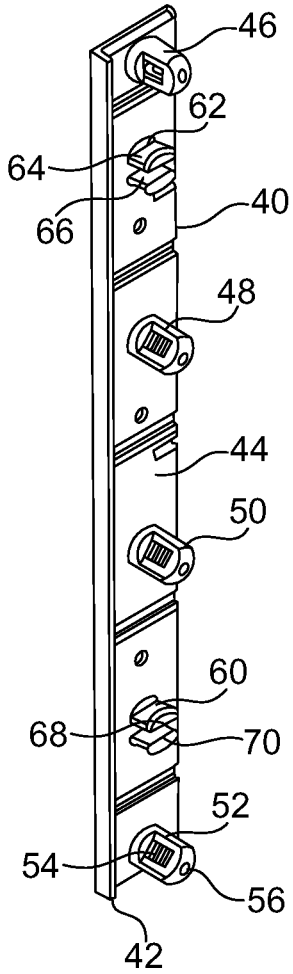
FIG. 3 is an isometric view of a compression plate for use in joining a pair of swimming pool side wall panels.
Figure 4:
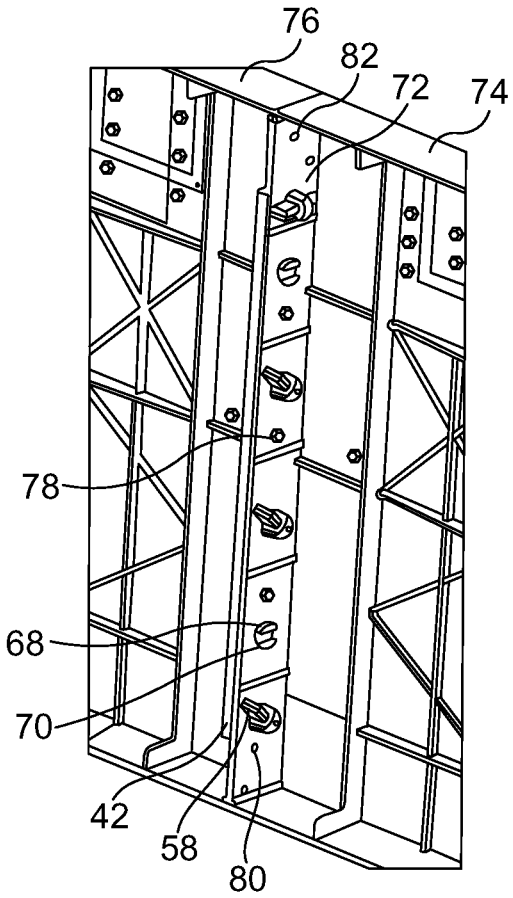
FIG. 4 is isometric view of a swimming pool assembly with the compression plate of FIG. 3 joining two swimming pool side wall panels.

According to another aspect of the present invention, one suitable technique for joining adjacent panels of the type shown in FIGS. 1 and 2, as well as for joining other known panel configurations, is illustrated in FIGS. 3 and 4. Referring now to FIG. 3, a compression plate assembly has an elongated generally planar blade 40 and an elongated lip 42 which functions as a seam encapsulation flange extending from one blade edge along the length thereof and in a direction generally orthogonal to the plane of the blade. The blade 40 and lip 42 have a common direction of elongation and are joined at a generally right angle along one common edge. A plurality of fasteners 46, 48, 50 and 52 extend from a single blade, generally designated as surface 44 in the same direction as the elongated lip 42 for joining a juxtaposed pair of swimming pool components. Each fastener comprises an alignment tower which is fixed to the blade 40 and has a transverse slot such as 54 near the free end 56 thereof for receiving a wedge 58 (FIG. 4). Two pre-alignment tabs 60 and 62 extend from blade surface 44 in the same general direction as the alignment towers and may be inserted into corresponding aligned edge flange apertures to temporarily hold the juxtaposed side wall panels or other swimming pool components in position during insertion and tightening of the wedges. Each pre-alignment tab comprises a bifurcated protuberance having a pair of flexible legs 64 and 66 extending from blade surface 44 with latching pawls 68 and 70 near respective free leg ends. This allows the legs to be flexed toward one another and the protuberance passed through respective aligned edge flange apertures and thereafter released with the pawls 68 and 70 engaging a flange surface such as 72 in FIG. 4 to join the components and compression plate. The adjoining flanges of the panels 74 and 76 have alignable apertures such as 80 and 82 for fastening deck supports, braces, optional bolts such as 78 and other conventional features as well as alignable apertures for receiving the alignment towers and the pre-alignment tabs.

Thus, the compression plate assembly of the present invention provides a wall joining system that uses wedges 58 instead of, or in addition to, optional bolts such as 78 and the lip 42 thereof encapsulates the rear wall seam between adjacent panels to reduce the amount of sediment, etc. that can seep between the wall flanges. The alignment towers 46, 48, 50 and 52 of the compression plate extend through aligned holes in the side flanges of the adjacent panels 74 and 76 and wedges are driven into slots such as 54 formed in the alignment towers. Insertion of wedges into the respective tower slots sandwiches the flanges between said one blade surface and 44 the wedges where they engage the flange surface 72. As seen in FIG. 4, the orientation of the slots such as 54 and wedges such as 58 may vary from nearly horizontal in tower 46 to quite oblique in tower 52 for convenience in driving the wedges. The snap fit arrangement on the pre-alignment tabs 60 and 62 temporarily holds the panels together until the wedges are driven into place. As indicated above, the draft angle and FML flats create a preload on the wedges which holds the wedges in place. Bolts may optionally be placed through respective holes in the side flanges of the adjacent panels for extra strength. The seam encapsulation flange 42 inhibits entry of sediment, etc. into the joint between adjacent wall panels.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A swimming pool having a plurality of wall panels secured together in an edge-to-edge relation to define the perimeter of said pool, at least one of said panels comprising:

a generally rectangular main body having a generally planar body face forming a portion of a pool side wall;

a pair of opposed edge flanges for juxtaposition with edge flanges of adjacent wall panels, the edge flanges extending from the plane of the body face at an angle differing from orthogonal by a small draft angle, each of said edge flanges including an outwardly facing surface which faces away from an opposing one of said edge flanges; and a plurality of elongated ribs extending along each of said edge flanges of said at least one panel in a direction generally orthogonal to the plane of the body face, each of said plurality of elongated ribs protruding beyond said outwardly facing surface of a respective one of said edge flanges, each of said plurality of elongated ribs being located along a respective one of said edge flanges and being thereby configured to abut with a corresponding elongated rib on an adjacent wall panel edge flange to compensate for draft angles and to position said body face generally coplanar with an adjacent panel face.

2. The swimming pool of claim 1, wherein each rib comprises an FML flat surface.

3. The swimming pool of claim 1, wherein each edge flange includes apertures for facilitating joining the panel to an adjacent wall panel.

* * * * *